United States Patent [19]

Jaschek et al.

[11] 4,405,341

[45] Sep. 20, 1983

[54] RESIN COATED FABRIC

[75] Inventors: Juergen Jaschek; Wolf Krummheuer, both of Wuppertal, Fed. Rep. of Germany

[73] Assignee: Akzona, Incorporated, Asheville, N.C.

[21] Appl. No.: 179,252

[22] Filed: Aug. 18, 1980

[30] Foreign Application Priority Data

Aug. 17, 1979 [DE] Fed. Rep. of Germany ..... 2933307

[51] Int. Cl.[3] ..... C09K 3/14

[52] U.S. Cl. ..... 51/298; 427/386; 427/412; 428/212; 428/240; 428/245; 428/246; 428/252; 428/260; 428/262; 428/265; 428/267

[58] Field of Search ..... 428/240, 245, 252, 253, 428/263, 265, 267, 260, 218, 246, 287, 290, 383, 212, 262; 427/386, 412; 51/298

[56] References Cited

U.S. PATENT DOCUMENTS

| | | | |
|---|---|---|---|
| 3,493,414 | 2/1970 | Hastings | 428/267 |
| 3,794,548 | 2/1974 | Wirth et al. | 428/267 |
| 4,175,931 | 11/1979 | Teschner | 51/298 |
| 4,233,358 | 11/1980 | Jones et al. | 428/265 |

*Primary Examiner*—James J. Bell

*Attorney, Agent, or Firm*—Antonelli, Terry & Wands

[57] ABSTRACT

A coated fabric consisting of continuous multifilament threads chemically activated and roughened to improve adhesion, having a fabric density between 26% and 60% and being coated with two layers of a plastics/synthetic resin mixture with different relative weights of the two layers.

22 Claims, 1 Drawing Figure

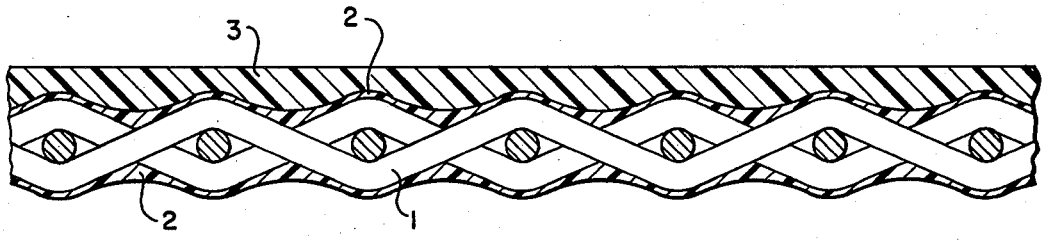
3
2
2
1

RESIN COATED FABRIC

The invention relates to a coated fabric. As a rule coated fabrics are composed of a woven or knitted fabric, a laid or similar thread structure, coated with rubber, plastic, synthetic resin or the like, and normally impermeable to liquids, air and gas. The advantages offered by these coated fabrics are especially due to the combination of known properties of conventional coated materials and the comparatively higher tenacity of the thread structures embedded therein.

Based on their favorable characteristics, coated fabrics find a great many diverse applications in industry as well as everyday life; e.g. in air-supported structures, stadium roofing/cover, packaging materials, tarpaulins, rubber/pneumatic rafts, roof truss insulations, etc. However, difficulties have been experienced time and again, especially where the adhesion between fabric and coating material was inadequate. A better adhesion is generally obtained with fabrics made of spun fiber yarns; this provides a reason for the preference shown these fabrics and why the well-known advantages of continuous multifilament yarns have not made unrestricted inroads in all fields. To meet the high demands made on the strength of coated fabrics consisting of staple fiber yarns, it was necessary in many cases to use only fabrics of high weaving density. Special problems were encountered in particular where because of special requirements to be met by the coated fabric the coating material consisted of synthetic resin or of a mixture of plastic and synthetic resin and additional high demands were made on the strength of the coated fabrics. There has, therefore, been no shortage of attempts to use continuous filament fabrics for these end uses, although so far all known efforts along this line have yielded only questionable results.

The subject matter of the present invention is, therefore, to make available a coated fabric whereby the adhesion between the fabric consisting of continuous multifilament threads or yarns and the coating mass composed in part of synthetic resin has been so improved that based on the superior adhesion and the comparatively higher strength of multifilament continuous threads, fabrics of a lower weaving density than heretofore customary can also be used. This objective is met with a coated fabric which consists according to the invention of a woven fabric of continuous multifilament threads whose surface, to improve adhesion, has been chemically activated and roughened, the fabric having a weaving density ranging between 26% and 60%, as well as a first and second coating composed of a plastic/synthetic resin mix, whereby the proportion by weight of the two components of the mix varies in both coatings.

The composition of the first coating insures excellent adhesion with the support fabric, whereby in spite of the presence of the second coating the coated fabric of the invention exhibits a high flexibility. The composition of the second coating permits the coated fabric of the invention to be used as is or to make it suitable for other end uses by the addition of other coatings.

Consequently, by taking advantage of the favorable characteristics of continuous multifilament threads, the invention provides a comparatively low fabric component without any loss in the serviceability of the coated fabrics of the invention.

Further improvement in adhesion between the fabric and the first coating is achieved when the fabric or the threads incorporated therein have been first subjected to any one of the treatments described in German Pat. Nos. 1 199 224, 1 212 245, 1 444 139, 1 444 140, 1 444 141 or 1 444 142. According to the invention, both sides of the fabric can be coated.

The coating fabrics of the invention can be made from fabrics having both a relatively high density of e.g. 60% and a relatively low density of e.g. 26%. Especially favorable results are, however, obtained with fabrics having a density ranging between 32% and 42%. The density of the fabric is determined according to the method described in "Textilpraxis" 1947 Edition, pp. 330 to 335 and 366 to 370.

Although serviceable results can already be obtained when the weight proportion of the plastic in the first coating and/or in the second coating represents as little as 0.2 times as well as 10 times the weight component of the synthetic resin in these coatings, the weight component of plastic in the first coating represents advantageously 1 to 4 times the weight component of synthetic resin, whereby excellent results are obtained when the weight component of the plastic amounts to 1.5 to twice the weight component of the synthetic resin. In the second coating the weight proportion plastic/synthetic resin is preferably smaller than 1.0.

In a preferred embodiment of the coated fabric of the invention the synthetic resin of the first and/or second coating is a phenolic resin and/or the plastic in the first and/or second coating is an elastic and/or thermoplastic substance.

An adequately high shape retention even in the presence of tensile stresses is obtained when the modulus of the fabric being used is not too high. With the coated fabric of the invention favorable results are obtained when the modulus of the fabric, measured at 55 daN/5 cm is less than 4% or measured at 90 daN/5 cm is less than 8%, but a fabric having less than 2% and less than 4% respectively, for the same values, is preferred, with excellent results being obtained when these values are below 1% and 2%, respectively. The modulus is obtained directly from the conventional force-elongation diagram produced by tensile stressing according to DIN 53 857 and DIN 53 354, respectively.

Although fabrics of conventional continuous multifilament threads are suitable for the production of the coated fabrics of the invention, especially advantageous are those containing polyester threads whose surface has been activated and roughened by means of an alkaline reaction promoter, and more specifically those containing polyethylene terephthalate. Very good results are also obtained with fabrics of aramid threads.

The favorable properties of the coated fabrics of the invention are under certain conditions furthermore improved in that at least the second coating contains up to 80% by weight of the coating of conventional inorganic fillers. An example of such a filler is $CaCO_3$.

Fabrics in the sense of the present invention are all sheet structures of fibers and/or filaments, thus e.g. conventional woven fabrics, webs, laid structures, knits and the like, whereby the sheet structure best suited for a specific end-use can be quickly and easily determined by appropriate test samples. These sheet structures may also be composed wholly or partly of spun fiber or spun fiber yarns, but the specific advantages of the coated fabrics of the invention will be obtained especially when the fabric consists of continuous multifilament threads or yarns. The fabrics suitable for the production of the coated fabric of the invention generally require no special, out-of-the-ordinary preliminary treatment. But it is possible, without anything further, to use fabrics embodying fibers whose surface has been activated and roughened beforehand by chemical action.

The term "synthetic resins" as used in the present invention is meant to define highly cross-linked duromeric substances obtained by polymerization, polycondensation or polyaddition, also referred to as duroplasts, which can also be mixed with curing agents, plasticizers, catalysts and the like. These synthetic resins comprise e.g. polyimide, phenolic, unsaturated or saturated polyester, epoxy or acrylic resins.

The term "plastics" as used in the present invention is meant to define slightly cross-linked, dispersible elastomeric or thermoplastic substances obtained by polymerization, polycondensation or polyaddition, which after drying, i.e. after elimination of the dispersing liquid, e.g. water, preferably present a rough surface structure. Plastics based on e.g. acrylics, acrylates, acrylonitrile polymer blends, polyvinyl acetate, epoxy and the like are suitable for this purpose.

The synthetic resins and plastics suitable for use with the coated fabric of the invention may be chemically related, i.e. belong to the same chemical system.

Flexibility or rigidity of the coated fabric of the invention can be adjusted to individual requirements by judicious selection of the ratio of plastic to synthetic resin in the coating mix.

The first coating serves as elastic film-former with a favorable film-formation on the carrier web, to prevent excessive penetration of the second coating in the carrier fabric, leading to a high degree of flexibility of the coated fabric of the invention. Generally the proportion of plastic in the first coating is greater than the proportion of plastic in the second coating, i.e. the first coating contains from 1.05 to 10 times as much plastics as the second coating.

Determination of the proportion of plastic and synthetic resin, respectively, in the two coatings of a sample is possible, for example, by preparing several sample strips with different proportions of the two mix components followed by control measurements of the sample and of the sample strips.

The coated fabric of the invention can generally be obtained by conventional, known processes whereby the coatings are successively applied to the fabric of spreading, by coating rolls, by dipping and the like, the application of one coating may under certain conditions be followed by full or partial drying, and/or setting or curing thereof. The carrier fabric may have been subjected beforehand to a chemical treatment causing the threads or fibers used for the support fabric to acquire an activated and toughened surface. It has been found very advantageous to combine the activation and roughening process with the application of the first coating, e.g. by incorporation of a substance that will effect such activation and roughening, i.e. a chemical reaction promoter.

It is, therefore, proposed for the manufacture of the coated fabric of the invention to apply in otherwise known manner the two coatings successively on the front and/or the back of the fabric and thereby to use according to the invention a fabric of continuous multifilament threads of a density ranging between 26% and 60% as a support fabric and to add, at least to the mix of a plastic and a synthetic resin, wherein the weight component of the plastic represents one to four times the weight component of the synthetic resin, prepared to form the first coating, a chemical reaction promoter activating and roughening the surface of the multifilaments of the fabric to improve adhesion, whereby the mix prepared to form the first coating comprises a higher proportion of the chemical reaction promoter than the mix prepared to form the second coating, based in each instance on the total quantity of the individual mix.

The mixes prepared for the two coatings are thereby preferably composed of a mixture of an aqueous colloidal plastic dispersion and a water-soluble synthetic resin plus the suitable chemical reaction promoter. A mix consisting of an acrylic-based plastic, in particular acrylonitrile and acrylate blend polymers, and a water-soluble synthetic resin on a phenol-formaldehyde basis was found eminently suitable.

Furthermore, fillers may also be added to the coating mixes. Depending on type and quantity of preferred inorganic fillers, application of the first coating on front and back of the fabric may be expedient.

To improve the wettability of the fabric, conventional wetting agents may be added to the mixes designed to form the two coatings.

When use is made of a fabric consisting of polyester threads, in particular polyethylene terephthalate threads, roughening and activation of the thread surface is obtained in a suitable manner by adjusting the mix prepared for the first coating to a pH ranging between 8 and 14, and the mix prepared for the second coating to a pH ranging between 7 and 14. This can be accomplished by addition of the alkaline reaction promoter, e.g. the proper quantity of lye (NaOH) or ammonia ($NH_3$) to the plastic/synthetic resin mix. The alkalinity of the mix prepared to form the second coating can be adjusted either to the same or a higher pH than that of the mix prepared for the first coating, but preferably it is adjusted to a lower pH. Very good results are obtained thereby when the mix prepared for the first coating is adjusted to a pH ranging between 10 and 14 and the mix prepared for the second coating is adjusted to a pH ranging between 8 and 12; particularly outstanding results are achieved when the pH of the first and second coating mixes is adjusted to a pH ranging between 12 and 13, and 9 and 11, respectively. It is also possible hereby to add to each mix prepared to form either coating different chemical reaction promoters, thus for example lye to one mix and ammonia to the other.

Because of the excellent adhesion between carrier fabric and coating material, the high degree of flexibility and strength, as well as low modulus, the coated fabric of the invention is versatile and can be widely used. Based on the cited, advantageous characteristics it is eminently suited for the manufacture of all types of abrasives which can advantageously be used for dry as well as wet-grinding processes, whereby the coated fabric of the invention is also excellent for the production of endless sanding belts. When the coated fabric of the invention is utilized for abrasives the fact that excellent adhesion of the grain binder coating is obtained on the second coating is particularly advantageous.

The invention is explained in detail in the illustration and the following examples and in the accompanying FIGURE which has a single FIGURE that shows a simplified embodiment of the coated fabric of the invention in cross section.

BRIEF DESCRIPTION OF THE DRAWING

In this version, fabric 1 composed of multifilament threads, is coated on front and back with a first coating 2. The coating material of which the first coating 2 is composed has penetrated in part into the interstices between individual multifilament threads of fabric 1 and partly also between individual filaments of the threads. On top of fabric 1 the second coating 3 is applied over the first coating 2. The finished coated fabric thus has an essentially smooth surface, while the bottom still reveals the structure of the embedded fabric 1.

EXAMPLE 1

For the production of the coated fabric of the invention use was made of a fabric of continuous multifilaments of polyethylene terephthalate whose threads exhibited the following characteristics:

Denier of threads (nominal denier): dtex 1100 f 210
Twist of threads: 60 tpm
Breaking strength of threads (approx.): 74 cN/tex
Breaking elongation of threads (approx.): 12.5%
The fabric was woven in plain weave.
Yarn density in warp and filling: 11 ends/cm
Fabric density: 39%
Weight per unit area: 255 g/m$^2$ This fabric was coated on both sides with a first coating whereby the level of application on each side of the finished product amounted to 50 g/m$^2$ on the front and 35 g/m$^2$ on the back. The composition of the mix for forming the first coating consists of:

20 parts by weight of an aqueous plastic dispersion composed of 48 wt.% of an acrylic plastic (solid component) and 52 wt.% water;

10 parts by weight of a solution composed of 70 wt.% modifed phenol-resol resin (solid component) and 30 wt.% water with a conventional solvent;

as well as 1.5 wt.% of a 6% aqueous NaOH solution.

The fabric with the first coating applied on both sides was exposed for 3 min. to a temperature of 90° C. Subsequently, the second coating was applied on the top of the coated fabric. The mix of this second coating was composed of:

10 parts by weight of the aqueous plastic dispersion that is used for the first coating;

20 parts by weight of the aqueous synthetic resin solution that is used for the first coating;

0.5 part by weight of a 6% aqueous NaOH solution and 1 part by weight of a conventional wetting agent.

Enough of this mix was applied so that the second coating in the finished product had a level of 20 g/m$^2$. After applying the mix of the second coating, the coated fabric obtained according to the invention was exposed for 3 minutes to a temperature of 90° C.

EXAMPLE 2

Retaining the data and process parameters outlined in Example 1, a coated fabric of the invention was obtained as follows and exhibited the following characteristics:

Yarn density in warp and filling of the woven fabric: 9 ends/cm
Fabric density: 33.5%
Weight per unit area of the fabric: 210 g/m$^2$ The mix designed as first coating also contained in addition 1.5 part by weight of a conventional thickening agent.

Level of application (only front) on the finished product: 80 g/m$^2$
Curing/drying conditions: 3 min. at 100° C.

The mix designed for the second coating contained in addition 10 parts by weight $CaCO_3$;

Level of application on finished product: 30 g/m$^2$
Curing/drying conditions: 2 min. at 100° C.

EXAMPLE 3

In another test, the coated fabric of the invention was obtained as follows:

Woven fabric: same as in Example 2

The mix designed for the first coating contained by comparison with Example 1 an additional 0.8 part by weight of a conventional thickening agent as well as 10 parts by weight of a conventional filler; the application level on the front of the finished product was 70 g/m$^2$, whereby duration and temperature of curing were 3 minutes and 90° C. The level of coating on the back of the finished product was 40 g/m$^2$, with a curing time of 2.5 minutes and a curing temperature of 85° C.

The second coating was the same as for Example 2.

EXAMPLE 4

A woven fabric of multifilament threads of polyethylene terephthalate having the following characteristics was used:

Denier of warp ends: dtex 550 f 96
Twist of warp ends: 130 tpm
Breaking strength of warp ends (approx.): 65 cN/tex
Breaking elongation of warp ends (approx.): 12%
Density of warp ends: 20 ends/cm
Denier of filling ends: dtex 1100 f 210
Twist of filling ends: 60 tpm
Breaking strength of filling ends (approx.): 75 cN/tex
Breaking elongation of filling ends (approx.): 12%
Density of filling ends: 8.5 ends/cm
The fabric was woven in plain weave and had a weight per unit area of 280 g/m$^2$ The fabric was coated on both sides with a first coating whereby the mix was applied to both sides to have in the finished product 80 g/m$^2$ on the front and 35 g/m$^2$ on the back.

The mix for the first coating had the following composition:

25 parts by weight of an aqueous plastic dispersion of the same make-up as described in Example 1;

5 parts by weight of a synthetic resin solution of the same make-up as described in Example 1;

1.5 parts by weight of an aqueous NaOH solution of the same make-up as described in Example 1; and 1 part by weight of a conventional thickening agent.

The fabric with a first coating on both sides was exposed for 3 minutes to a temperature of 90° C. Subsequently, the second coating was applied to the top of said coated fabric. The mix designed for this had the following composition:

10 parts by weight of an aqueous plastic dispersion of the same make-up as described in Example 1;

25 parts by weight of an aqueous synthetic resin solution of the same make-up as described in Example 1;

0.2 part by weight of an aqueous NaOH solution of the same make-up as described in Example 1;

0.5 part by weight of a conventional wetting agent; and 15 parts by weight $CaCO_3$.

Enough of this mix was applied that the second coating in the finished product had an application level of 30 g/m². After application of the mix for the second coating, the coated fabric was exposed for 3 minutes to a temperature of 90° C.

EXAMPLE 5

In this example, in preparing the coated fabric of the invention use was made of a woven fabric of continuous Aramid multifilament threads of dtex 1200 f 750. The fabric was woven in a plain weave, whereby:

Thread density in warp and filling: 9 ends/cm
Fabric density: 34%
Weight per unit area: 220 g/m²
Breaking strength of ends: 220 cN/tex
Breaking elongation of ends: 2%

The mix designed for the first coating had the same composition as that described in Example 1 with the exception that this mix contained 0.8 part by weight of a 6% aqueous NaOH solution. The thermal treatment of the fabric after the first coating corresponded likewise to that described in Example 1.

The mix designed for the second coating had the following composition:

10 parts by weight of an aqueous plastic dispersion as described in Example 1;

20 parts by weight of an aqueous synthetic resin solution as described in Example 1;

15 parts by weight of an aqueous synthetic resin solution as described in Example 1;

15 parts by weight $CaCO_3$; and 0.2 part by weight of a 6% aqueous NaOH solution.

Application level of the second coat in the finished product was 30 g/m², curing and drying conditions were 3 minutes and 95° C.

EXAMPLE 6

The woven fabric used in the case was a blend of continuous polyester multifilament threads as filling ends and continuous Aramid threads as warp ends. The polyester threads had a denier of dtex 1100 f 210, their density was 9 ends/cm. The Aramid threads had a nominal denier of dtex 420 f 250, their thread density in the woven fabric was 18 ends/cm. The fabric was woven in a plain weave and weighed 200 g/m².

Breaking strength of Aramid threads: 180 cN/tex
Breaking elongation of Aramid threads: 3.5%

Corresponding data for polyester threads are given in Example 4.

All other data and/or process parameters were as indicated in Example 5.

EXAMPLE 7

To demonstrate that the coating of the invention can also be obtained when using woven fabrics of staple fiber yarns, use was made of a fabric of Aramid staple fiber yarn of a denier of 1200 dtex. Density of warp and filling ends in the finished fabric was 9 ends/cm corresponding to a fabric density of 34% and a weight per unit area of 220 g/m².

The fabric was woven in a plain weave.

All other process parameters and data were as indicated in Example 5.

All the coated fabrics of the invention obtained as outlined in the listed examples produced excellent abrasives.

What is claimed is:

1. A coated fabric comprising a fabric of continuous multifilament threads, the fabric having a density ranging between 26% and 60%, a first coating applied to the fabric and a second coating applied over the first coating, the first and second coating each comprising a mix of a dispersable elastic and/or thermoplastic substance with a highly crosslinked duroplastic substance, the proportion of the elastic and/or thermoplastic substance to highly crosslinked duroplastic substance in each mix varying from the first coating to the second coating.

2. A coated fabric according to claim 1, wherein the amount of elastic and/or thermoplastic substance in the mix of the first coating is one to four parts by weight per one part by weight of highly crosslinked duroplastic substance, and the amount of elastic and/or thermoplastic substance in the mix of the second coating is less than one part by weight per one part by weight of highly crosslinked duroplastic substance.

3. A plastic coated fabric according to claim 1, characterized in that the elastic and/or thermoplastic substance is 1.5 to 2 parts by weight of the highly crosslinked duroplastic substance.

4. A coated fabric according to claims 1 or 2, wherein the fabric has a density that ranges between 32% to 42%.

5. A coated fabric according to claims 1 or 2, wherein the fabric has a modulus <4% and 8%, respectively, when measured at 55 daN/5 cm and 90 daN/5 cm, respectively.

6. A coated fabric according to claim 5, wherein the modulus of the fabric when measured at 55 daN/5 cm and 90 daN/5 cm is less than 2% and 4%, respectively.

7. A coated fabric according to claim 6, wherein the modulus of the fabric when measured at 55 daNa/5 cm and 90 daN/5 cm is less than 1% and 2%, respectively.

8. A coated fabric according to claim 1, wherein the fabric consists of polyester threads having surfaces activated and roughened by an alkaline reaction promoter.

9. A coated fabric according to claim 1, wherein the fabric is composed of aramid threads.

10. A coated fabric according to claim 1, wherein the highly crosslinked duroplastic substance is a phenol-formaldehyde resin and the elastic and/or thermoplastic substance is an acrylic resin.

11. A coated fabric according to claim 1, further comprising a layer of abrasives bonded to said second coating.

12. A coated fabric according to claim 1, wherein said mix of the first coating contains 1.05 to 10 times as much of the elastic and/or thermoplastic substance as the second coating.

13. A coated fabric according to claim 1, wherein said highly crosslinked duroplastic substance is a duroplast selected from the group consisting of polyimide resin, phenolic resin, unsaturated by saturated polyester resin, epoxy resin, and acrylic resin.

14. A coated fabric according to claim 10, wherein said fabric is comprised of polyethylene terephthalate.

15. A coated fabric according to claim 14, wherein the mix for forming the first coating also contains a chemical reaction promoter for activating and roughing the surface of a multifilament thread of the fabric to improve adhesion.

16. A coated fabric according to claim 1, wherein at least the mix of the first coating contains a chemical reaction promotor for activating and roughening the surface of the multifilament threads in order to improve adhesion and said mix of the first coating containing a larger proportion of the reaction promotor than the mix of the second coating, based in each base on the total quantity of each mix.

17. A coated fabric according to claim 1, wherein the mix for forming the first coating also contains a chemical reaction promotor for activating and roughening the surface of a multifilament spread of the fabric to improve adhesion.

18. A coated fabric according to claim 1, wherein the content of the elastic and/or thermoplastic substance in the mix of the first coating is from one to four parts by weight per one part by weight of the highly crosslinked duroplastic substance and at least the mix of the first coating contains a chemical reaction promotor for activating and roughening the surface of the multicomponent threads of the fabric in order to improve adhesion, the mix of the first coating containing a larger proportion of the chemical reaction promotor than the mix of the second coating, based in each case on the total quantity of each mix.

19. A process for the manufacture of a polymer coated fabric which comprises applying two different coatings of a mix of dispersable elastic and/or thermoplastic substance with a highly crosslinked duroplastic substance in succession to the front and/or back side of the fabric, said fabric being formed of continuous multifilament threads and having a fabric density ranging between 26% and 60%, at least the mix for the first coating, in which the content of the elastic and/or thermoplastic substance is from one to four parts by weight per one part by weight of the highly crosslinked duroplastic substance, having been admixed with a reaction promoter for activating and roughening the surface of the multifilament threads in order to improve adhesion, and the mix for the first coating containing a larger proportion of the chemical reaction promoter than the mix for the second coating, based in each case on the total quantity of each mix.

20. A process according to claim 19, wherein the fabric is a fabric of polyester threads and the mix for the first coating is adjusted to a pH range between 8 and 14 and the mix for the second coating is adjusted to a pH range between 7 and 14.

21. A process according to claim 19, wherein the mix of the first coating is adjusted to a pH range between 10 and 14 and the mix for the second coating is adjusted to a pH range between 8 and 12.

22. A process according to claim 19, wherein the mix for the first coating is adjusted to a pH range between 12 and 13, and the mix for the second coating is adjusted by a pH range between 9 and 11.

* * * * *